United States Patent [19]

Mitter

[11] 4,041,860

[45] Aug. 16, 1977

[54] SCREEN PRINTING MACHINE

[75] Inventor: Mathias Mitter, Verl, Germany

[73] Assignee: Mitter & Co., Schloss Holte, Germany

[21] Appl. No.: 571,410

[22] Filed: Apr. 24, 1975

[51] Int. Cl.[2] ..... B41F 15/10; B41F 15/38

[52] U.S. Cl. ..... 101/122; 101/128.1

[58] Field of Search ..... 101/121, 122, 115, 127.1, 101/128.1; 198/136, 202, 208; 51/148; 40/96

[56] References Cited

U.S. PATENT DOCUMENTS

| | | | |
|---|---|---|---|
| 2,019,375 | 10/1935 | Wheelwright | 101/115 |
| 2,294,962 | 9/1942 | Cassell | 198/202 |
| 2,928,340 | 3/1960 | Stein et al. | 101/127.1 X |
| 3,102,469 | 9/1963 | Sherman | 101/122 |
| 3,232,224 | 2/1966 | Kramer | 101/120 |
| 3,359,663 | 12/1967 | Black | 101/127.1 X |
| 3,451,174 | 6/1969 | Schaller | 51/148 |
| 3,541,957 | 11/1970 | Bubley | 101/127.1 |
| 3,598,049 | 8/1971 | Dias | 101/122 |
| 3,835,773 | 9/1974 | Vasilantone | 101/122 |
| 3,892,176 | 7/1975 | van der Winden | 101/127.1 X |

FOREIGN PATENT DOCUMENTS

| | | | |
|---|---|---|---|
| 1,260,424 | 2/1968 | Germany | 101/122 |

*Primary Examiner*—Edgar S. Burr
*Assistant Examiner*—R. E. Suter
*Attorney, Agent, or Firm*—Michael J. Striker

[57] ABSTRACT

An endless printing screen is trained about two or more guide rollers for travel in an endless path. Abutment members in form of longitudinally continuous or discontinuous elements are mounted on the respective lateral edge portions of the screen, extending from one of the screen surfaces. Tensioning units are mounted adjacent these edge portions and are provided with grooves through which the abutment members travel. Each tensioning unit at one of the lateral edge portions is connected with a tension unit at the opposite lateral edge portion by an arrangement which makes it possible to move the tensioning units apart from one another in direction transversely of the travel of the printing screen, thereby tensioning the printing screen. The thus-connected tensioning units can also be moved in toto in direction transversely of the travel of the printing screen.

18 Claims, 26 Drawing Figures

21
913
44
42
C
91
277
7
33
9
5
D
108
118
18
6
4
45
3
9
7
33
C
43a
43
46
41
20
913
1
1

21
33
277
91
42
277
22
10
25
7
7
2
108
3
108

4
7
45
6
7
35
25
33
9
42
43
9
22
20
41

Fig. 19
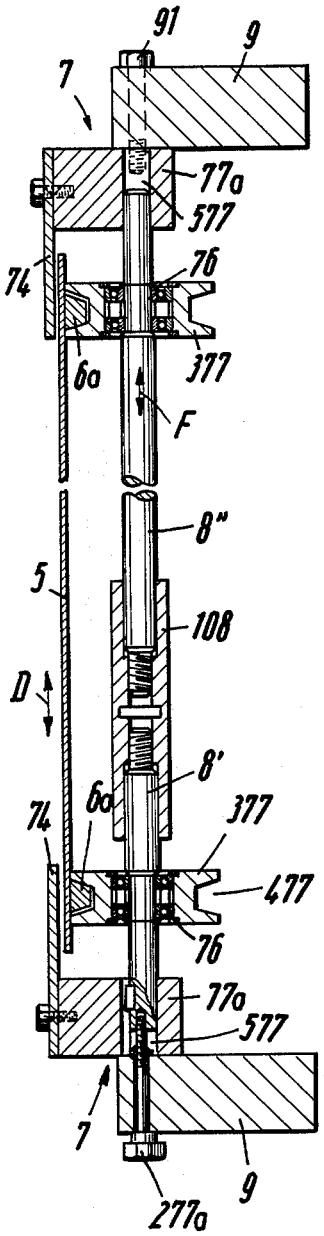
Fig. 18
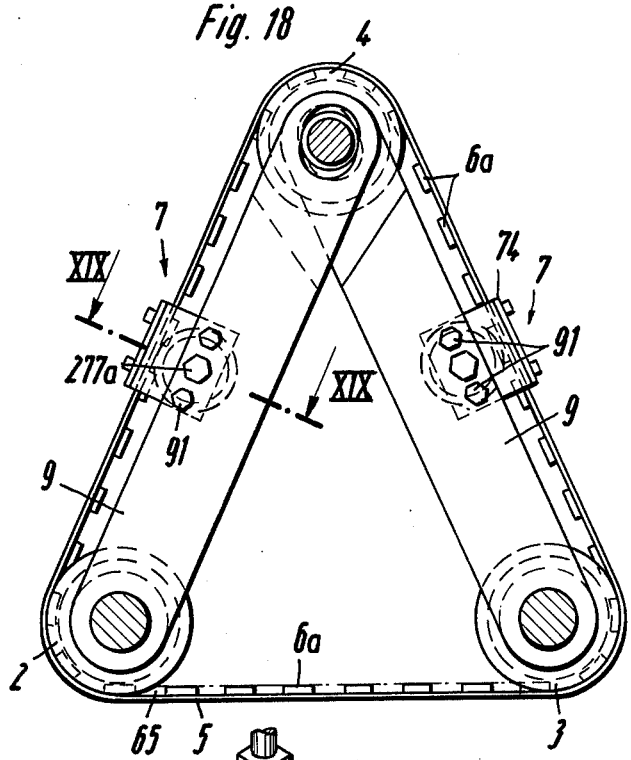
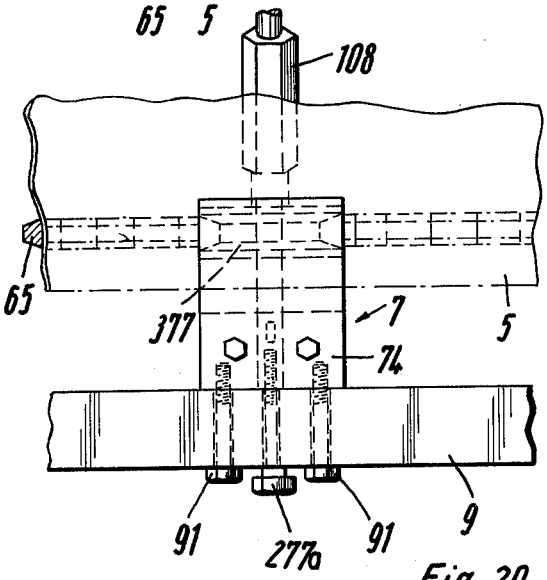
Fig. 20

81
184
85
85a
84a
84
183
XXII
XXII
F
83
80

84
81
284
84a
84a

SCREEN PRINTING MACHINE

BACKGROUND OF THE INVENTION

The present invention generally concerns a printing machine, and in particular a screen printing machine. Still more particularly, the invention is directed to a screen printing machine having an endless printing screen which is trained about two or more guide rollers and travels in an endless path.

Printing machines of this type are well known in the art. Thus, U.S. Pat. No. 2,019,375 describes a printing machine having an endless printing screen which is trained about a plurality of guide rollers. The axes of two of the rollers are located in a plane parallel to the surface of the material to be printed, and a third roller is located in a plane above the two rollers substantially midway between the latter. This third roller can be raised and lowered, thereby making it possible to tension the printing screen in longitudinal direction, i.e. in the direction of its travel. For purposes of tensioning the printing screen in lateral direction, i.e. transversely of its direction of travel, each edge of the printing screen is attached to a thin strip of metal or other stiffening material provided with inwardly projecting pins that are spaced apart at equal distances longitudinally of the screen for engagement with a number of similarly spaced recesses in the rollers about which the printing screen is trained. The purpose of this latter arrangement is to prevent the opposite lateral edges of the printing screen from moving transversely of the direction of travel towards the center of the printing screen, a danger which exists at all times because it is almost impossible to prevent the guide rollers — which are journalled only at their opposite axial ends — from flexing through at the center under the influence of the longitudinal stress of the printing screen.

The shifting or creeping of the lateral edges of the printing screen inwardly towards the center can occur because such printing screens are structurally relatively unstable. They are in many instances composed of wire mesh and, although the inward movement of the lateral edges has been sought to be avoided by fixing the wires of the mesh to one another where they intersect, this was often not sufficient to prevent the problem. The tensioning of the printing screen in its direction of travel, i.e. in its longitudinal direction, therefore must be calculated very carefully not only with respect to the strength and stability of the screen fabric itself, but also with respect to the behavior of the screen during movement in its endless path and in such a manner as to hopefully avoid the movement of the lateral edges of the printing screen inwardly towards one another. However, such printing screens operate at rather high speeds and the factors involved are relatively uncontrollable at these speeds if resort is had merely to a control of the adjustment of the screen tension in longitudinal direction of the screen. It is for this reason that U.S. Pat. No. 2,019,375 proposes to utilize the strips mounted on the lateral edge portions and provided with pins which engage into recesses of the guide rollers.

While the construction of U.S. Pat. No. 2,019,375 does not permit an adjustment in the transverse tensioning of the printing screen, an arrangement which does permit such an adjustment is disclosed in German Pat. No. 1,260,424. In this patent an adjustable tension can be exerted upon one lateral edge of the printing screen, for the purpose of further improving the quality of prints that are made with the arrangement. If, however, the arrangement is used in a machine where two or more patterns (or colors) are to be printed in registration, then difficulties exist because when a stress is exerted upon the one lateral edge of the printing screen in order to tension the screen, the screen fabric is pulled sufficiently so as to cause a degree of displacement of the screen pattern in the direction towards the edge upon which tension is being exerted, so that proper registration of consecutive printed patterns is no longer assured. Therefore, this construction is not intended and cannot be used for multi-pattern printing where successive patterns must be registered with one another, and certainly not for multi-color printing.

SUMMARY OF THE INVENTION

It is a general object of this invention to overcome the problems which exist in the prior art.

More particularly, it is an object of the present invention to provide an improved screen printing machine wherein the printing screen can be tensioned transversely of its direction of travel without incurring the disadvantages outlined above.

Another object of the invention is to provide such an improved screen printing machine wherein it is possible not only to tension the printing screen, but also to shift it physically in direction transversely of its travel.

A concomitant object of the invention is to provide such a screen printing machine wherein the instrumentalities required for effecting the purposes of the invention are simple in construction and reliable in operation.

In keeping with these objects, and with others which will become apparent hereafter, one feature of the invention resides, in a screen printing machine, in a combination which comprises at least two guide rollers, an endless printing screen having two lateral edge portions and being trained about the guide rollers for travel in an endless path, abutment means mounted on the edge portions for travel with the screen, and tensioning means engaging the abutment means and operative for tensioning the screen in direction transversely of the path by urging the abutment means of the respective edge portions apart from one another.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS:

FIG. 18 is a view similar to FIG. 5, but illustrating the embodiment of FIG. 15;

FIG. 19 is a section taken on line XIX—XIX of FIG. 18;

FIG. 20 is a view similar to that of FIG. 7, but of the embodiment in FIG. 15;

DESCRIPTION OF THE PREFERRED EMBODIMENTS:

FIG. 1-8 illustrate one embodiment of the invention. The screen printing machine in these Figures will be seen to have a machine frame or support 1 on which one or more printing stations are arranged. In the illustrated embodiment, two printing stations A and B are provided, but a single printing station or more than two of them, could also be utilized.

Figure 1:
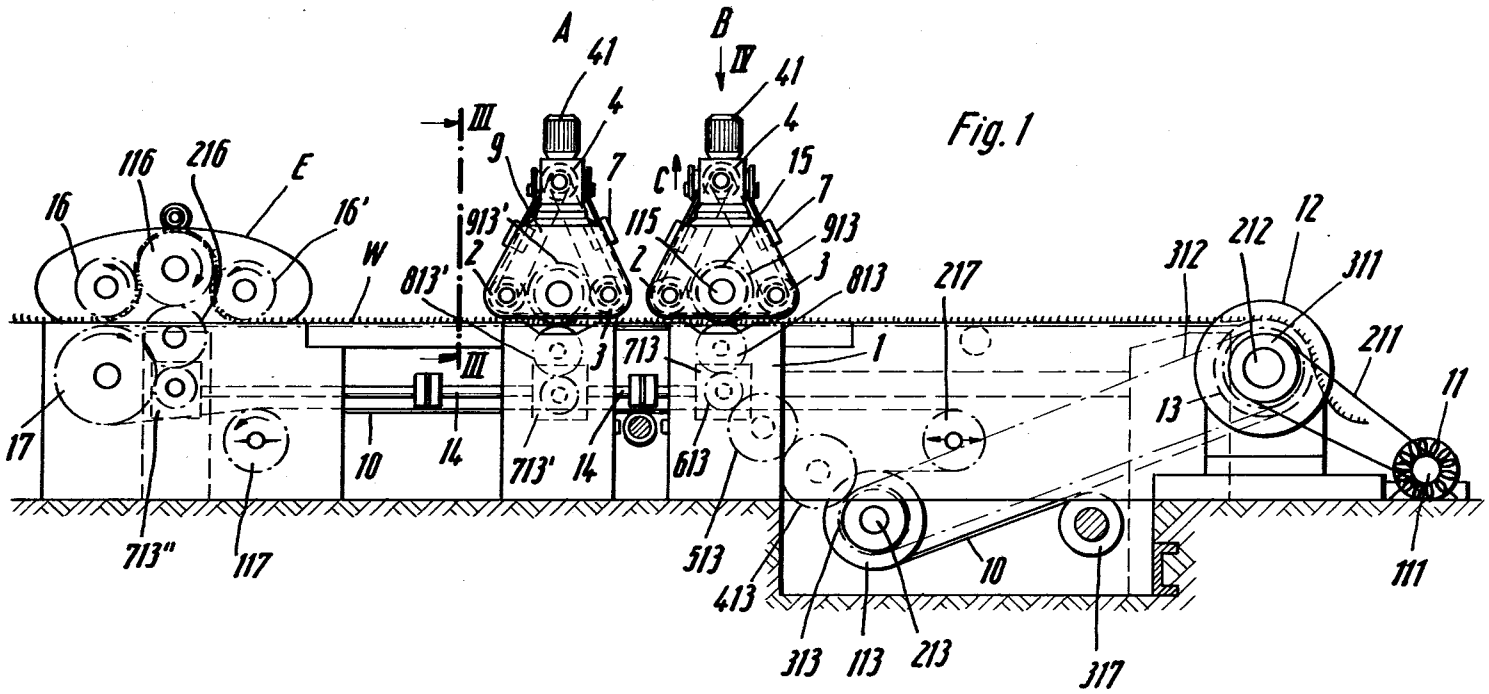
FIG. 1 is a somewhat diagrammatic side view of a screen printing machine according to one embodiment of the invention.
Figure 3:
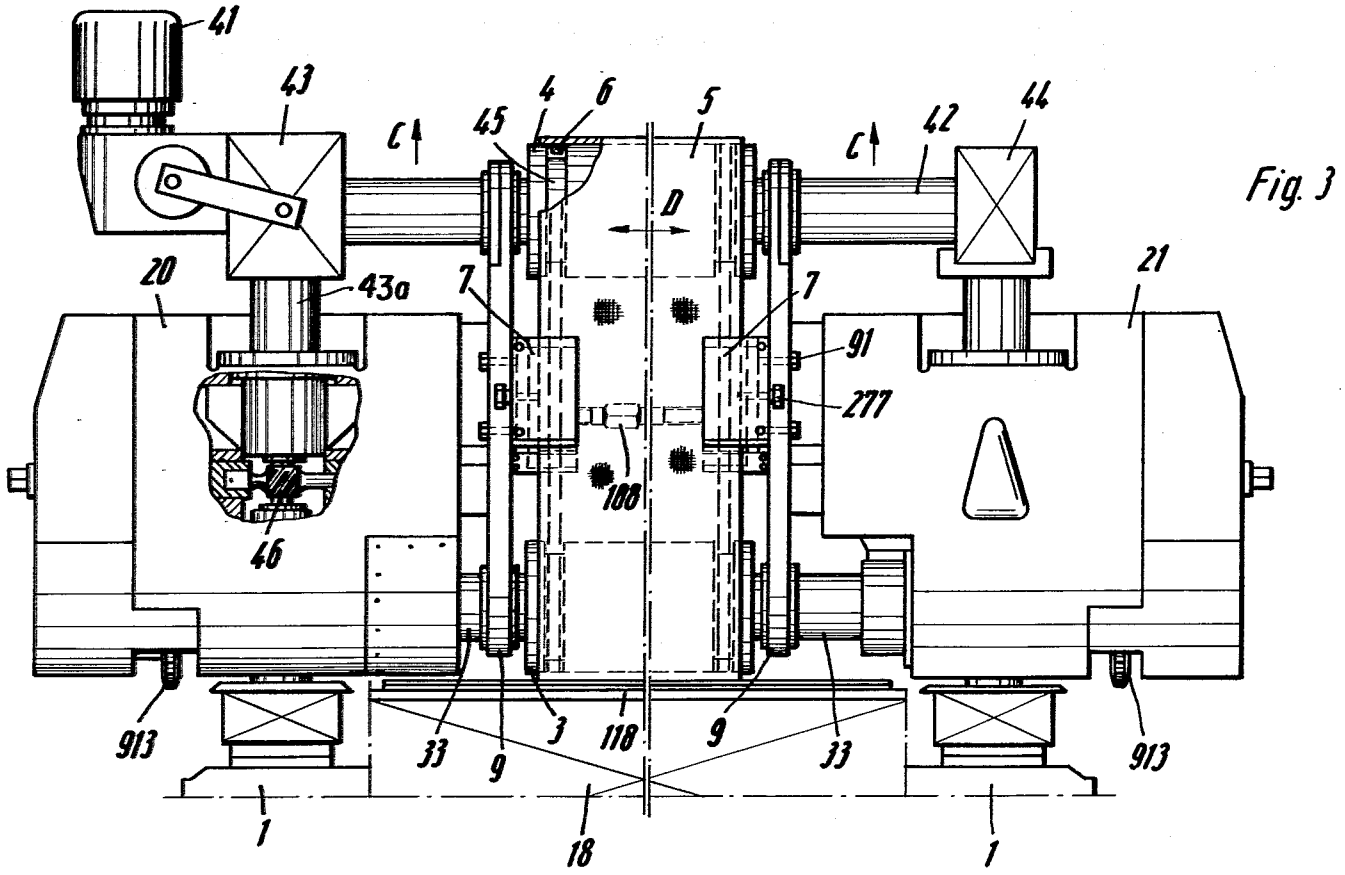
FIG. 3 is a section on line III—III of FIG. 1.

The web W to be printed, e.g. a carpet or the like, is supplied seriatim to the printing stations A and B on an endless travelling printing blanket 10 whose upper run passes beneath the printing stations A and B. The printing blanket 10 is trained about a roller 17 at the inlet side of the machine where the web W is supplied, a roller 13 at the outlet side where the web W leaves the machine, a reversing roller 113 and two printing-blanket tensioning rollers 117 and 217. These rollers 117 and 217 are spring biassed and mounted for resilient movement against the spring bias in the direction of the double-headed arrows which are associated with them. This is, of course, a measure which is well known per se in the art. A cleaning roller 317 may also be provided over or past which the printing blanket 10 must travel and which scrubs possible contaminants off the web-supporting surface of the printing blanket. As FIGS. 1 and 3 show, the upper run of the printing blanket 10 is supported on counter pressure elements 18 having a removable supporting strip 118 which can be replaced in the event of wear and/or to compensate for varying thicknesses of different webs W.

Figure 2:
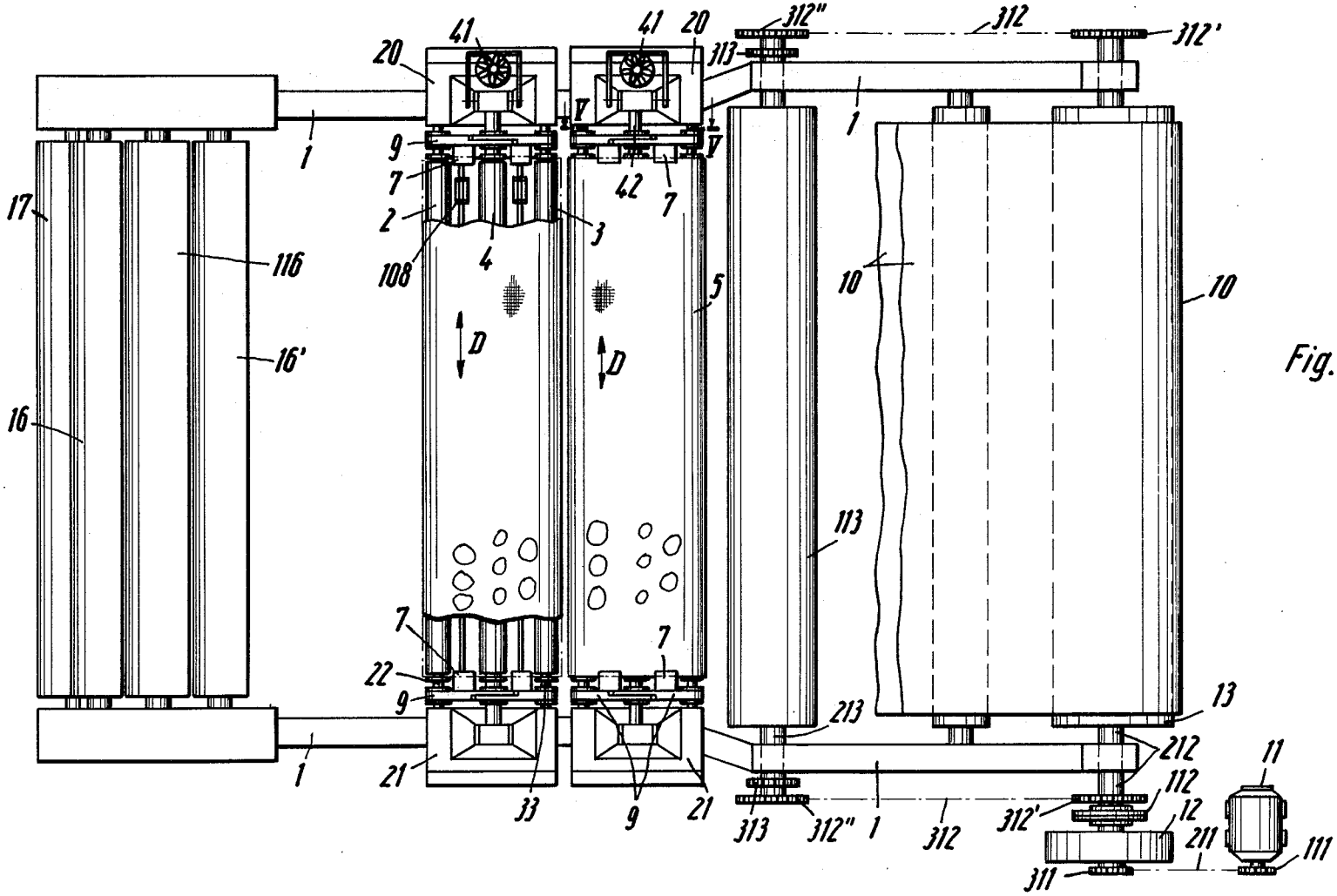
FIG. 2 is a top-plan view of FIG. 1, with certain elements omitted for the sake of clarity.

A motor 11 (see FIGS. 1, 2) is provided which drives the printing blanket 10 via a chain drive 211 having chain sprockets 111 and 311, a planetary gear drive 12, and a coupling 112 (FIG. 2). This drive 211 is supplied to a further chain drive 312. A main drive shaft 212 has mounted on it the reversing roller 13 for the printing blanket 10. The chain drive 312 may be located at only one or at both lateral sides of the machine. In the event that the printing blanket 10 itself is to be utilized for driving the roller 113 or the shaft 213 thereof, the chain drive 312 can be omitted since the printing blanket 10 would then itself provide a frictional drive for the roller 113. In the illustrated embodiment, however, the chain drive 312 is provided, and it has the sprockets 312′ and 312‴. The chain drive 312 drives a gear 313 which is mounted on the shaft 213 which in turn carries, as observed before, the roller 113 of the endless printing blanket 10.

The purpose of providing the gear 313, which is mounted on and rotates with the shaft 213, is to drive from it a series of gears 314, 513 and 613 which in turn transmit motion to an angle drive 713 which serve to rotate a main machine drive shaft 14 which extends lengthwise of the machine. Again, such a main drive shaft 14 may be located at only one lateral side of the machine, or two of them may be provided, each located at a different lateral side of the machine. The drive shaft 14 serves to drive the intake unit E which is located at the inlet end of the machine and serves to draw the web W into the latter. The manner in which drive is transmitted from the shaft 14 to the unit E is shown only diagrammatically in the drawing, as it is not directly relevant to the present inventive concept. However, details of the drive are disclosed in my copending application Ser. No. 483,698 to which reference may be had.

Figure 5:
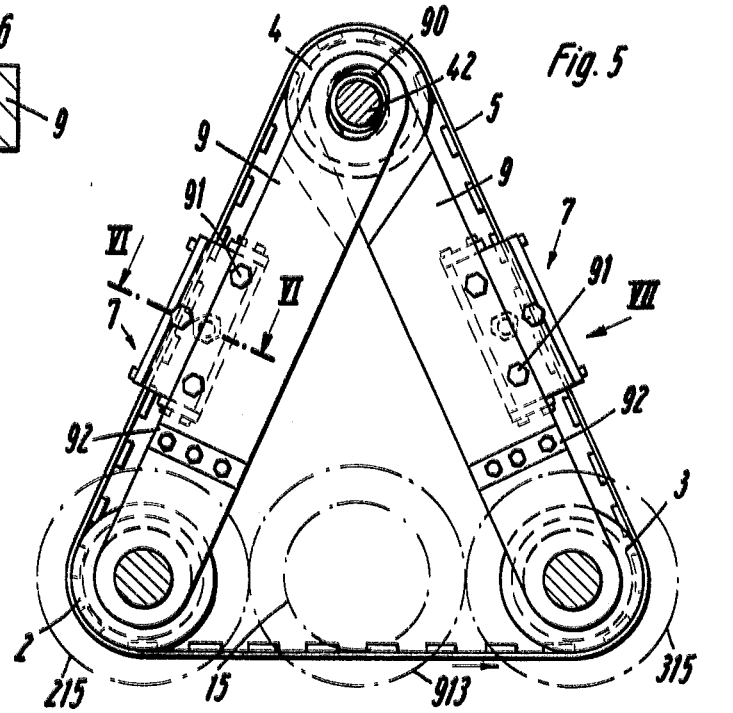
FIG. 5 is a section taken on line V—V of FIG. 2.
Figure 7:
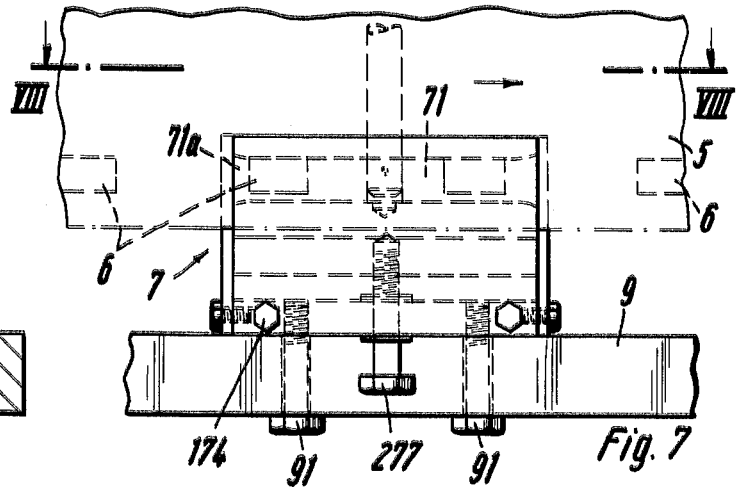
FIG. 7 is a view showing a detail of FIG. 5, as seen in the direction of the arrow VII.
Figure 8:
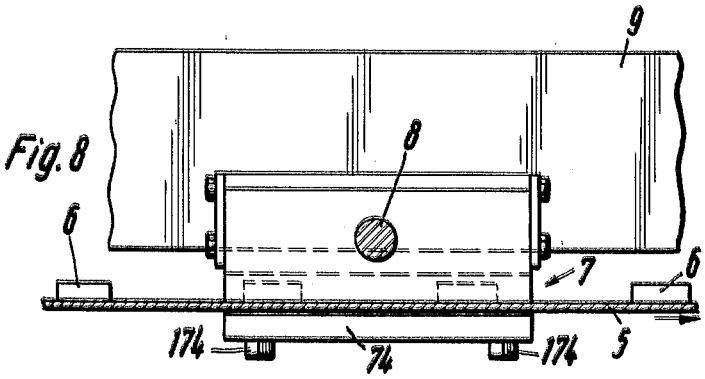
FIG. 8 is a section taken on line VIII—VIII of FIG. 7.

The angle drive 713 is located at the printing station B; similar angle drives 713′ and 713″ are located at and associated with the printing station A and the intake unit E, respectively. It is these angle drives which transmit motion from the drive shaft 14 to the units B, A and E, respectively. This has been illustrated by way of example in FIG. 1 where it will be seen that the angle drive 713 drives a gear 813 which in turn meshes with a gear 913 mounted on the shaft 115 of a roller squeegee 15 that is located in the interior of the printing station B. The gear 913 in turn meshes with gears 215 and 315 of two screen drive and guide rollers 2 and 3, respectively (FIG. 5). As far as the unit A is concerned, a similar gear 913′ is provided. Details of the drive for the unit A are shown in FIG. 5. Of course, it is conceivable to use not a roller squeegee, but a different type of squeegee, in which case the drive may be chosen correspondingly different. What is important is that the drive rollers 2 and 3 which in the respective printing stations or units A and B provide the drive for the printing screen 5, be driven in rotation in suitable manner.

As far as the drive for the intake unit E is concerned, it will be seen (particularly in FIG. 1) that the unit E has three cooperating rollers 16, 16′ and 116. The rollers 16 and 16′ have their axes located in a plane parallel to the upper run of the printing blanket 10 and the rollers 16 and 16′ press the incoming web W against this upper run. The roller 116 is located midway between and at a higher level than the rollers 16, 16′ and has the incoming web trained around it. The roller 116 is driven in rotation by a gear 216 which is mounted on its shaft and receives its drive from the angle drive 713″. However, if desired the drive could also be derived from the roller 17.

FIG. 2 shows diagrammatically that these aforementioned drives could be supplied at both lateral sides of the machine (please note that only a portion of each drive is shown to suggest this possibility) but that the drives are not fully illustrated to avoid excessive encumberance of the Figure. However, it should be kept in mind that the drives could also be provided at only one lateral side of the machine.

Figure 4:
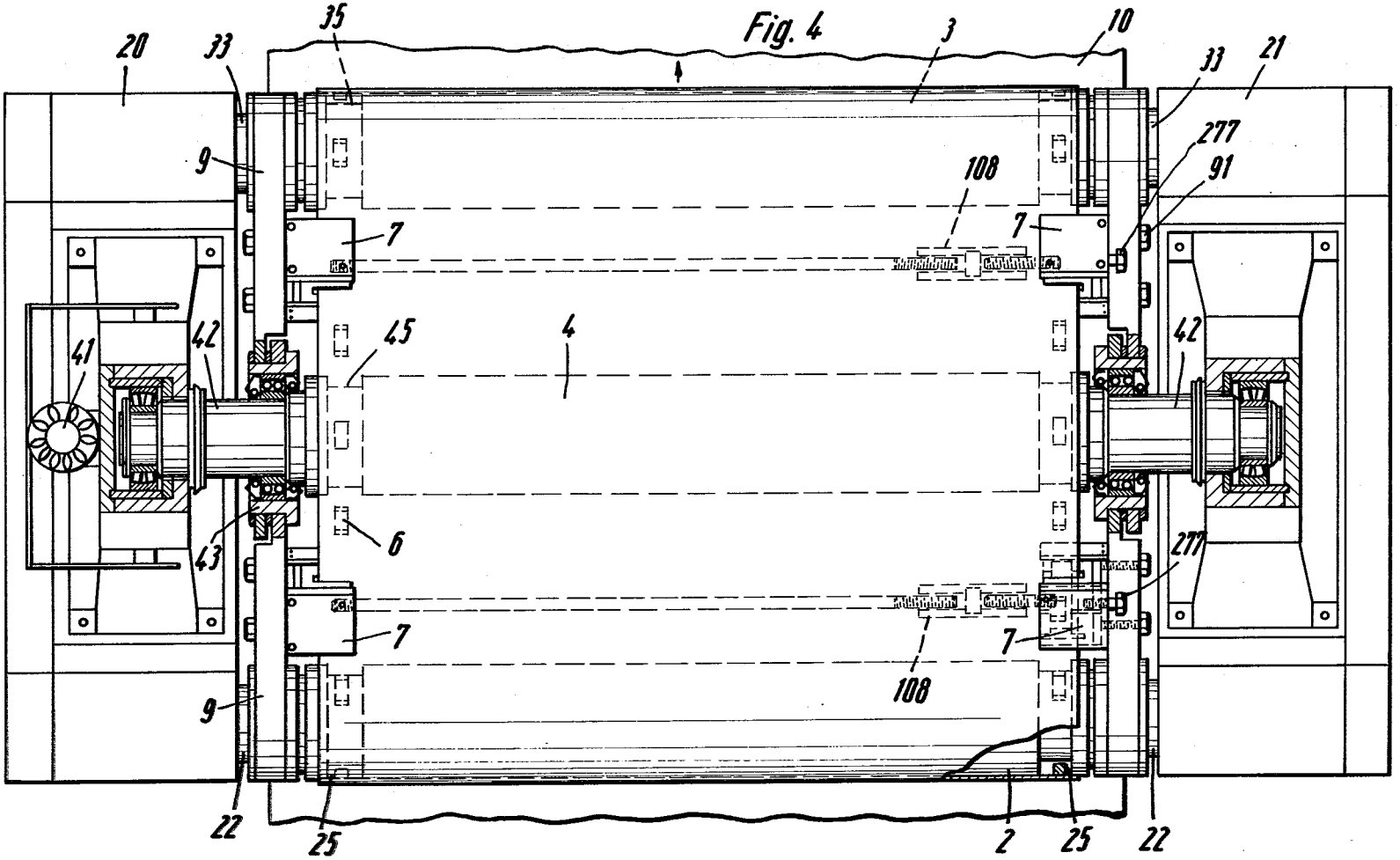
FIG. 4 is a top-plan view of a detail of FIG. 1, as seen in the direction of the arrow IV.
Figure 9:
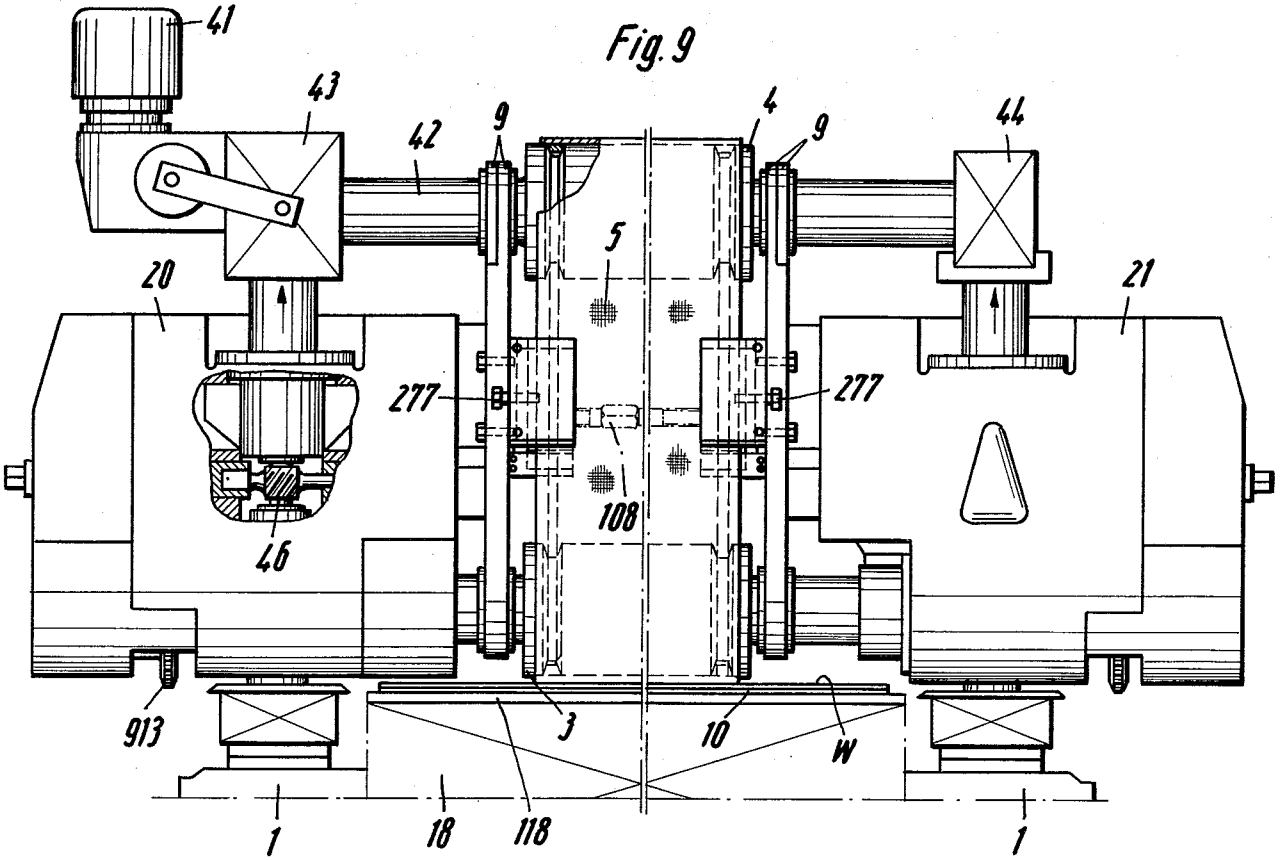
FIG. 9 is a view analogous to FIG. 3, but illustrating a detail of a further embodiment of the invention.
Figure 16:
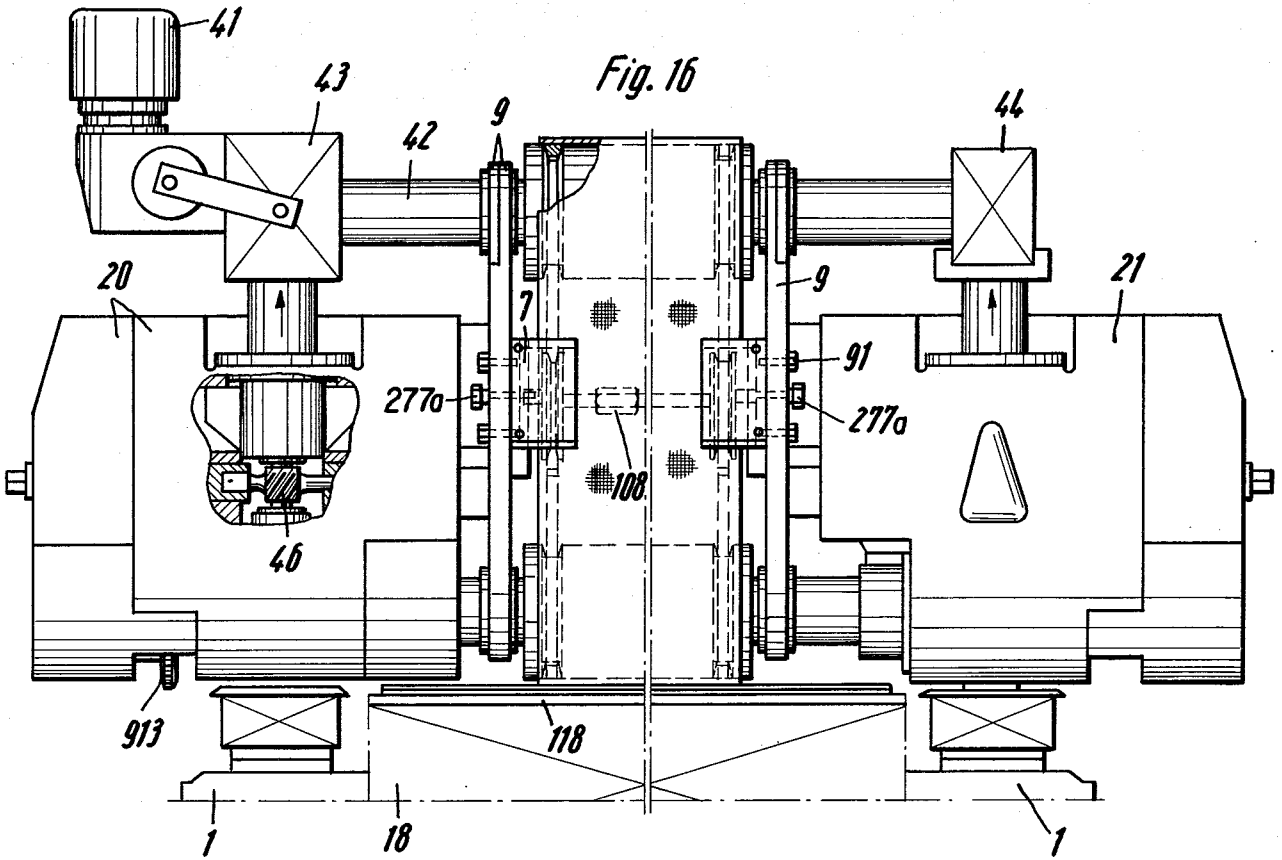
FIG. 16 is a view similar to FIG. 3, but of the embodiment in FIG. 15.
Figure 17:
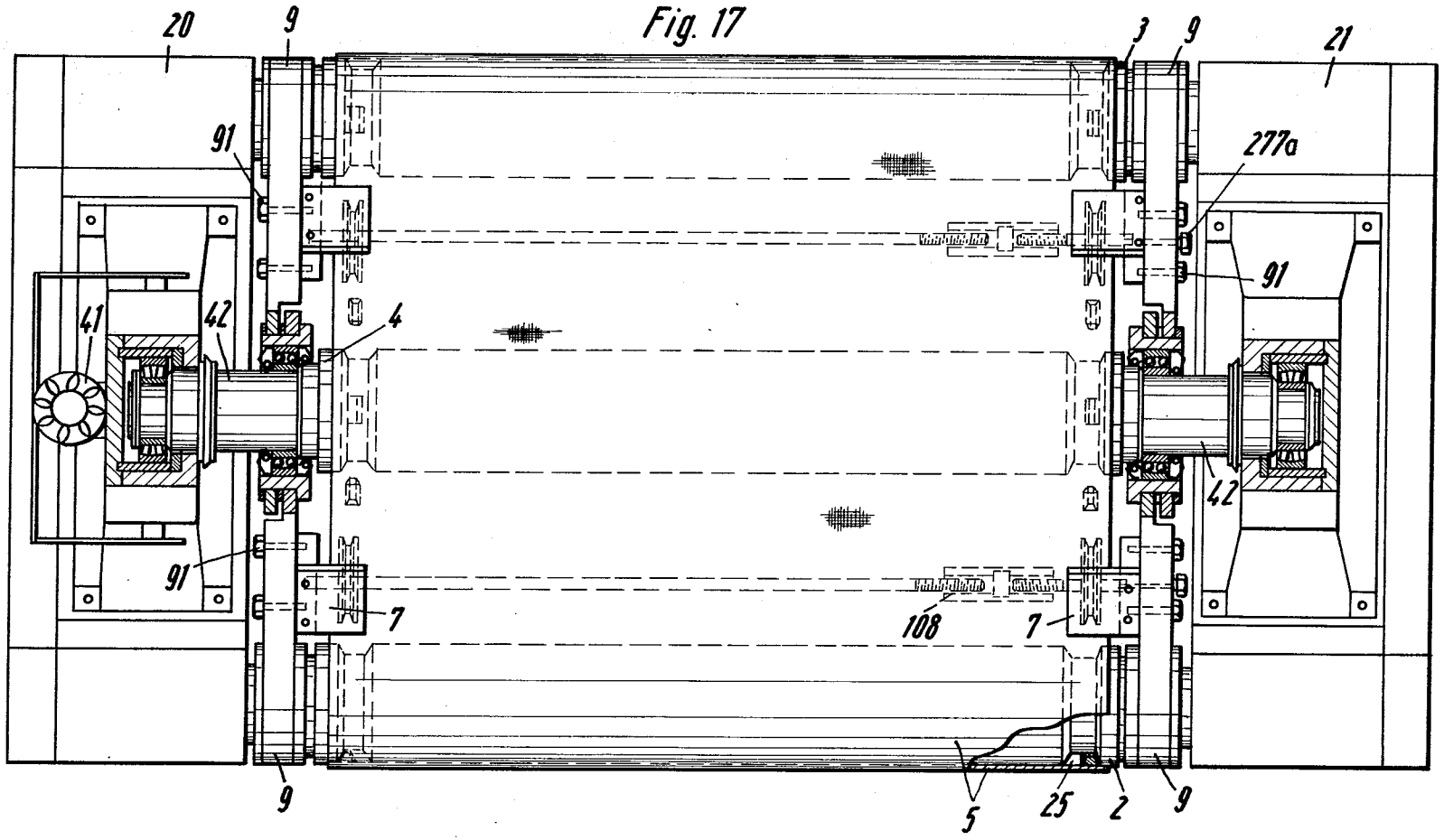
FIG. 17 is a top-plan view of the printing station B in FIG. 15.

One of the printing stations, namely the printing station B, is shown in more detail in FIGS. 3 and 4. It has two end mounts 20 and 21 which are mounted on the machine frame 1 at opposite lateral sides of the machine. The end mounts 20 and 21 support the journals of the rollers for the printing screen 5; in the illustrated embodiment there are three rollers 2, 3 and 4 provided. The rollers 2 and 3 have their axes located parallel to the working plane, i.e. to the upper run of the printing blanket 1, and the roller 4 has its axis located in a plane upwardly spaced from the rollers 2, 3 midway between the latter rollers; the purpose of the roller 4 is to serve as a tensioning roller which tensions the printing screen 5 in longitudinal direction, i.e. in its direction of travel. The means for effecting the adjustments of the roller 4 are not shown in detail herein, but are described clearly in my prior U.S. application Ser. No. 458,342 to which reference may be had. The adjustment of the roller 4 is effected by means of a motor 41 which causes movement of the roller 4 in a horizontal direction by pivoting roller 4 and bearing 43 thereof about the vertical axis of shaft 43a. The bearing 44 is a slide bearing permitting such pivoting of roller 4 in a horizontal plane. The vertical displacement of the roller 4 may be effected by the means described in U.S. Pat. No. 2,019,375. Raising of the roller 4 and of its bearings 43, 44 may be carried out in accordance with the details described in my prior U.S. application Ser. No. 458,342, utilizing a worm drive 46 which is shown in FIGS. 3, 9 and 16 and which acts upon a not-illustrated spindle and serves to raise the bearings 43 and 44, or lower them as the case may be.

FIG. 5 shows most clearly that the rollers 2, 3 and 4 are arranged at the corners of an imaginary triangle and that the printing screen 5 is trained about them for travel in an endless path. The arrow C (see FIG. 1) indicates that the roller 4 may be raised in order to tension the printing screen 5 in its longitudinal direction, i.e. in the manner which is already known per se in the art.

The printing screen 5 may be in form of a wire mesh or a perforated stainless-steel foil, also as known in the art. It cooperates in a manner known per se with the diagrammatically illustrated squeegee 15, here illustrated as a roller squeegee which is located within the area surrounded by the printing screen 5. The printing screen can be tensioned as outlined above, and since the axis of the roller 4 may be moved skew in a horizontal plane, the travel of the printing screen 5 about the rollers 2, 3 and 4 can also be influenced, as disclosed in my prior application Ser. No. 458,342. It should be understood, incidentally, that although three rollers 2, 3 and 4 have been illustrated in the present application, it is conceivable to utilize only two rollers, namely the rollers 2 and 3, if a different embodiment should be chosen.

As was indicated in the introductory portions of the present application, the tensioning which can be imparted to the printing screen 5 in the longitudinal direction of the latter, i.e. in the direction of the travel of the printing screen about the rollers 2, 3 and 4, is not sufficient. Such tensioning does not prevent — and may, if the rollers should bend through intermediate their bearings provided at their respective axial ends, actually enhance — the receding of the lateral edge portions of the printing screen in direction towards one another, that is towards the center of the printing screen 5. To prevent this, and therefore the difficulties which result from such a possibility, the present invention provides a tensioning arrangement which permits tensioning of the printing screen 5 in direction transversely of its elongation, i.e. in FIG. 5 in direction normal to the plane of the drawing. However, it is important according to the present invention that this tensioning be possible with respect to each of the lateral edge portions, so that tension is exerted upon one lateral edge portion in one laterally outward direction while tension is exerted upon the opposite lateral edge portion in the opposite laterally outward direction. For this purpose the lateral edge portions of the printing screen 5 carry abutment means 6 (FIGS. 4, 7, 8) which travel with the printing screen 5 and project from a surface thereof, in the illustrated embodiment the surface which faces inwardly of the imaginary triangle around which the printing screen 5 travels (compare FIG. 5). As other Figures (e.g. FIGS. 2 and 6) show, these abutment means are engaged by tensioning means or units 7 which serve to pull the abutment means in laterally outward direction, but in mutually opposite directions at the opposite lateral edge portions of the printing screen 5, so that the printing screen 5 will be subjected to tensioning in both directions indicated by the double-headed arrow D (see FIGS. 2 and 6).

Figure 23:
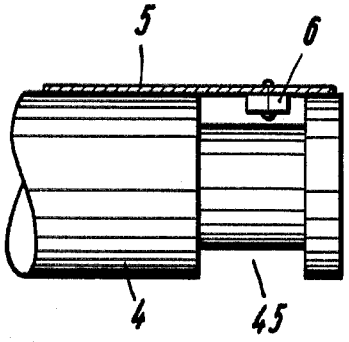
FIG. 23 is a fragmentary elevation showing one end of a roller according to the invention.

As mentioned before, in the illustrated embodiment the abutment means are provided on that surface of the printing screen 5 which faces inwardly of the imaginary triangle in which the printing screen travels. To avoid interference with the abutment means 6 under these circumstances, the end portions of the rollers 2, 3 and 4 are provided with relatively wide (in axial direction of the rollers) circumferential recesses 25, 35 and 45, (FIG. 4) respectively through which the abutment means 6 can travel without hindrance. The length or width of the recesses in axial direction of the rollers 2, 3 and 4 has been chosen relatively wide, i.e. significantly wider than the width of the abutment means 6 in the same direction, in order to permit a shifting of the printing screen 5 with the abutment means 6 thereon, in axial direction of the rollers 2, 3 and 4 if and when it is desired to effect such shifting. How this shifting can be carried out, will be described subsequently. The relatively significant width of the recesses by comparison to the dimension of the abutment means 6 in the same direction is clearly shown on hand of FIG. 23 where an abutment means 6 is shown as it travels through the recess 45 of the roller 4; this showing is representative of the rollers 2 and 3 also.

Figure 24:
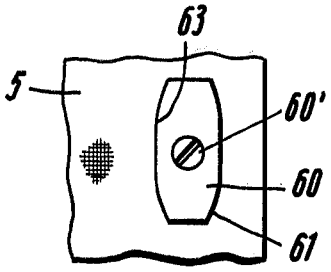
FIG. 24 is a fragmentary plan view illustrating a further detail of the invention.
Figure 25:
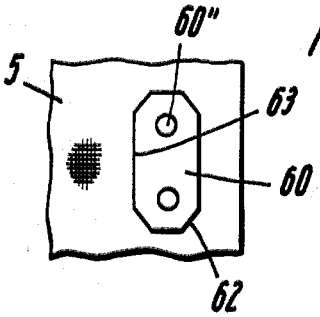
FIG. 25 is a view similar to FIG. 24, illustrating a somewhat different embodiment.

In FIGS. 4–8 the abutment means 6 are constructed in form of individual abutment members 60 which may have the configurations shown in FIGS. 24 and 25, respectively. A plurality of the abutment members 60 is arranged along each of the lateral edges or edge portions of the printing screen 5, spaced longitudinally thereof, that is spaced in the direction of travel of the printing screen 5. At least at one end (but if desired at both ends as shown in FIGS. 24 and 25) each abutment member 60 will be tapered in width to facilitate the entry of the respective abutment member into the tensioning units 7 which will be described subsequently. FIG. 24 shows that the tapering at least at one end, that is the leading end as seen with respect to the direction of travel of the printing screen, may be effected by providing the abutment members 60 with curved edge faces 61 (FIG. 24) or with bevelled edge faces 62 (FIG. 25). They also have longitudinally extending edge faces 63. The abutment members 60 may be mounted on the printing screen by means of one or more screws 60' (FIG. 24) or by means of one or more rivets 60'' (FIG. 25). They may also be more closely spaced (lengthwise of the printing screen 5) than this is illustrated in the drawings, for example in FIG. 4, in order to avoid the possibility of sagging of the screen 5 between the successive abutment members 60.

Figure 6:
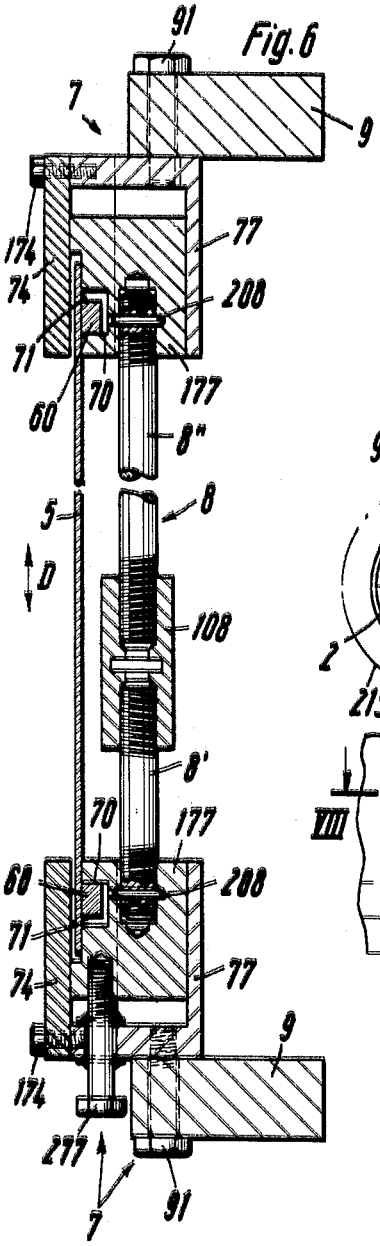
FIG. 6 is a section taken on line VI—VI of FIG. 5.
Figure 11:
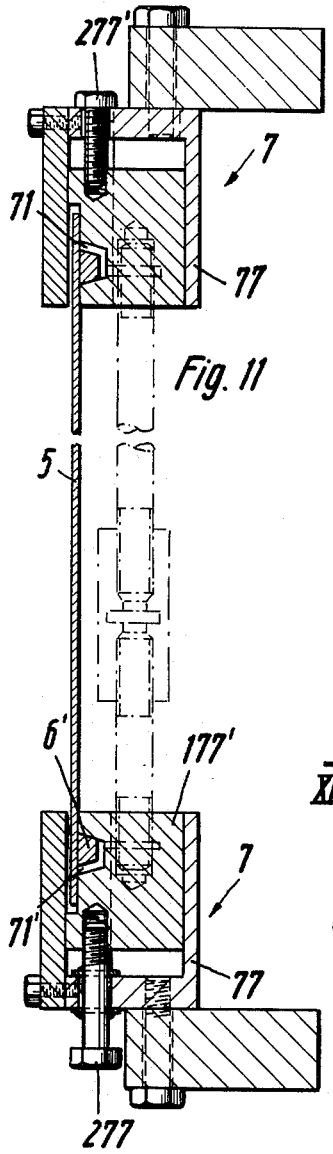
FIG. 11 is a section on line XI—XI of FIG. 10.

The tensioning means or tensioning units 7 are illustrated in more detail in FIGS. 6 and 19 and, to some extent, also in FIG. 11. They are mounted on end plates or members 9 which are pivotably secured on the shafts of the rollers 2 and 3 at opposite lateral sides of the printing screen, i.e. at the opposite axial ends of the rollers 2 and 3. These members 9 overlap one another with their upper ends in the region of the shaft 42 of the roller 4. In this region they each have a slot-shaped opening 90 which is shown in FIG. 5 so as to permit adjustment in the position of the roller 4 in vertical as well as in horizontal direction without interference by the members 9. The openings 90 may of course also be made longer then illustrated, depending upon the degree of adjustment which is desired. Hindrance of the horizontal adjustment of the roller 4 is avoided due to the fact that the members 9 are freely pivotable on the shafts of the rollers 2, 3 and are provided with the slot-shaped openings 90 through which the shaft 42 of the roller 4 extends. It it is desired to be able to increase or decrease the length of the members 9, the members 9 may each be made of two sections which are connected by an extension section 92 that can be inserted and connected with the two sections, or can be removed therefrom, in which latter case the two sections would then be connected directly to one another. FIG. 5 shows that the connection can be effected by means of screws or bolts (diagrammatically shown) but this is of course fully within the skill of those conversant with this art. The upper end portions of the members 9, in the region of the shaft 42 of the roller 4, are stepped, i.e. the thickness of the members 9 (in FIG. 5 normal to the plane of the drawings) is less at the upper end portions than in the remainder of the respective member 9. The thickness is so chosen that where the upper end portions of reduced thickness overlap one another, so that the shaft 42 of the roller 4 can extend through the holes 90 in both of them, the combined thickness of the overlapping upper end portions corresponds to the individual thickness of each member 9 in the region downwardly of its upper end portion. This is also shown in FIG. 4. As that Figure also shows, the upper end portions may have installed in them a bearing 43, e.g. a ball bearing, in which the shaft 42 of the roller 40 is journalled. Similar bearings are provided for the shafts 22 and 23 of the driven rollers 2, 3.

Each of the members 9 carries, midway between the roller 4 and the rollers 2 and 3, respectively, a tensioning unit 7 which is mounted on the respective member 9 in suitable manner, for example by means of screws and bolts 91 (compare FIG. 6). Thus, in the region of one lateral edge of the printing screen 5 the two members 9 located thereat are provided with two of the units 7, and at the opposite lateral edge (at the opposite axial ends of the rollers 2, 3, 4) there are two further units 7 provided. In the illustrated embodiment each of the units 7 is composed of an angular member 77 which is the one that is secured to the respective member 9, which carries a slidable member 177 provided at an exposed surface thereof with a recess or groove 71 bounded by side faces 70. The abutment members 60 engage these side faces 70 as they travel through the recesses or grooves 71. To prevent a disengagement of the abutment members 60 from the grooves the slide members 177 are overlapped by respective plates or cover members 74 which may be secured to the respective angle member 77 by screws 174, or in any other desired manner. At least the inlet end 71a of each of these grooves, i.e. the end where the respective abutment members 60 enter the grooves during travel with the printing screen 5 in the direction indicated by the arrow in FIG. 7, should be made divergent in direction opposite to the travel, so that due to this divergence the members 60 can enter more readily into the respective groove 71 and, due to the decrease in the cross-section of the groove in the direction of travel of the screen 5, the members 60 will be urged laterally outwardly of their associated screen edge portion, so that the screen becomes tensioned as each member 60 moves from the inlet portion 71a into the main portion of the respective groove 71.

The sliding member 177 of each unit located at one lateral edge of the printing screen 5 is connected with the sliding member 177 of a similar unit located at the opposite lateral edge of the printing screen 5. In FIGS. 1–8 this connection is established by a connecting device 8 which in this embodiment is in form of two threaded rods 8', 8'' (see FIG. 6). The rods 8' and 8'' have first end portions which are located adjacent one another and of which one is formed with a right-hand thread and the other is formed with a left-hand thread. A tensioning nut or sleeve 108, having a passage which at one end is also formed at the right-hand thread and at the other end is formed with a left-hand thread, is threaded onto these adjacent first end portions. The opposite end portions of the rods 8', 8'' extending to recesses of the slide members 177 in which they are secured against axial shifting and rotation in suitable manner, for example by pins 208 which extend through bores in the slide members 177 and also extend through similar bores in the rods 8', 8''. It is known that when in such a construction the sleeve 108 is turned in one direction it will pull the rods 8', 8'' axially towards one another, whereas when it is turned in the opposite direction it will push the rods 8', 8'' axially apart from one another. Thus, when the sleeve 108 is turned in this latter direction, the rods 8', 8'' will move axially apart from one another and will similarly shift the slide members 177 of the two connected units 7 apart from one another (within the respective angle members 77), thus exerting tension upon the screen 5 in the two opposite directions indicated by the double-headed arrow D. The farther the sleeve 108 is turned in this sense, the stronger will be the tension.

According to the present invention, it is also desired to be able to effect an adjustment in the position of the screen 5 on the rollers 2, 3 and 4, in direction axially of the latter. This is done by making it possible to shift each set of two units 7 connected by the connecting device 8, in axial direction of the rollers 2–4. For this purpose a screw or bolt 277 is passed through a sleeve bore in one of the angle members 77 (compare FIG. 6) and is mounted in this bore against axial shifting, for example (as shown in FIG. 6) by forming the shaft of the screw 277 at two locations which are located adjacent the inner and outer side of the leg in which the bore is formed, with circumferential grooves in which circlips are received. The threaded end of the screw 277 extends into a tapped bore of the slide member 177 so that, when the screw 277 is turned in requisite direction, the slide member 177 will either move in one direction (e.g. upwardly in FIG. 6) or in the opposite direction (e.g. downwardly in FIG. 6). This motion will be transmitted via the connecting device 8 to the other slide member 177 located at the opposite lateral side of the screen 5, and since the screen is coupled with the two slide members by means of the abutment members 60 which extend into the groove 71, the screen 5 will be forced to participate in this movement.

FIG. 11 shows that it is also possible to omit the connecting element 8, so that the slide members 177 of the units at the opposite lateral edge portions of the screen 5 will not be connected with one another, except via the abutment members 6' mounted on the screen 5. In such a case the desired tensioning of the screen 5 in the directions indicated by the double-headed arrow D of FIG. 6 is obtained by providing each of the slide members 177 with a screw 277 of 277', respectively. It will be evident that by requisite turning of the screws 277, 277', the desired tensioning in direction of the arrow D is obtained. To obtain further the shifting of the screen which is otherwise accomplished in FIG. 6 via the screw 277 alone, FIG. 11 requires that either the screw 277 is tightened to cause the screen 5 to be pulled in one direction (i.e. downwardly in FIG. 11) and at the same time the screw 277' is loosened to permit such movement, or vice versa. The connecting element 8 has been illustrated in broken lines in FIG. 11 for the exclusive purpose of comparison with FIG. 6; in actual fact it will, however, not be present for the reasons explained above. Nevertheless, it should be understood that the use of the connecting element 8, as in FIG. 6, is more advantageous than the embodiment in FIG. 11 because it permits a simpler adjustment.

Figure 10:
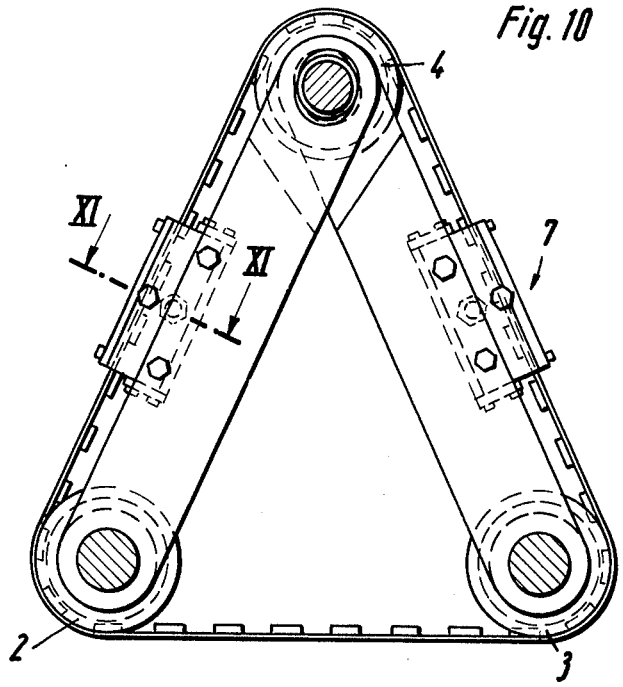
FIG. 10 is a view corresponding to FIG. 5, but illustrating the embodiment of FIG. 9.
Figure 12:
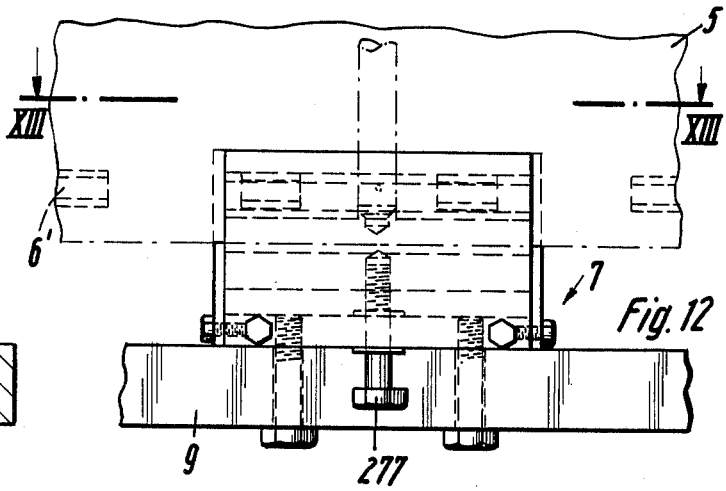
FIG. 12 is a view corresponding to FIG. 7, but illustrating the embodiment of FIG. 9.
Figure 13:
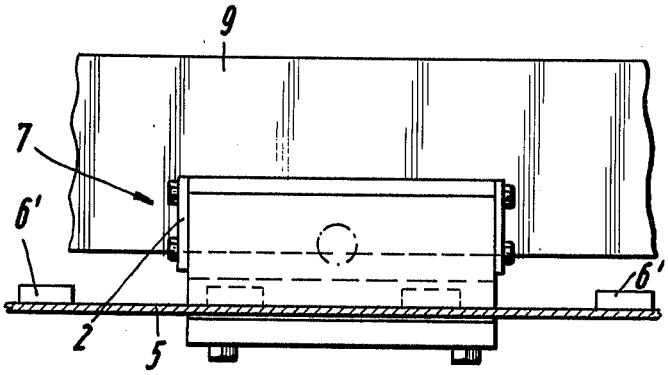
FIG. 13 is a section on line XIII—XIII of FIG. 12.
Figure 14:
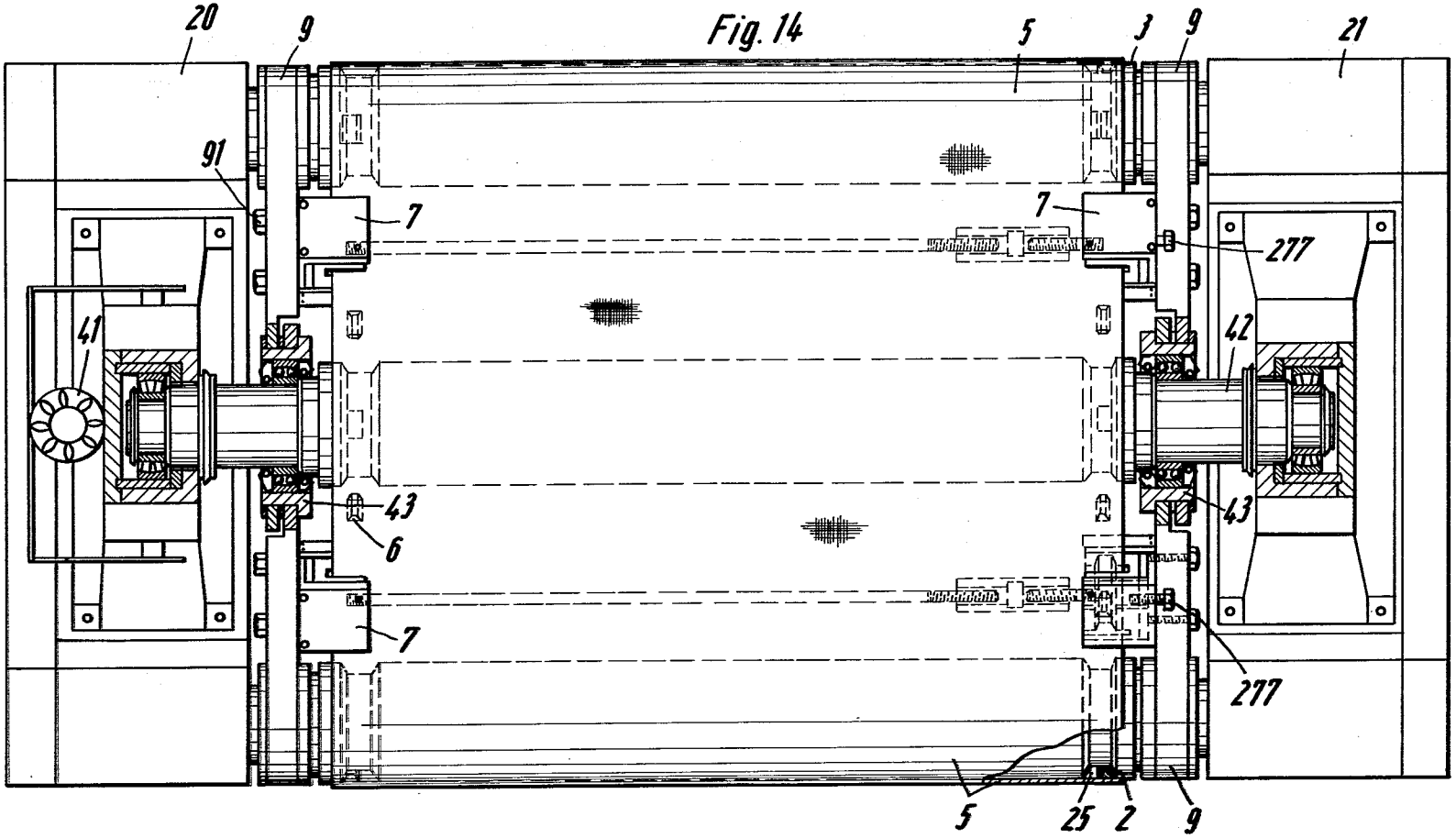
FIG. 14 also illustrates the embodiment of FIG. 9, in a view similar to that of FIG. 2.
Figure 15:
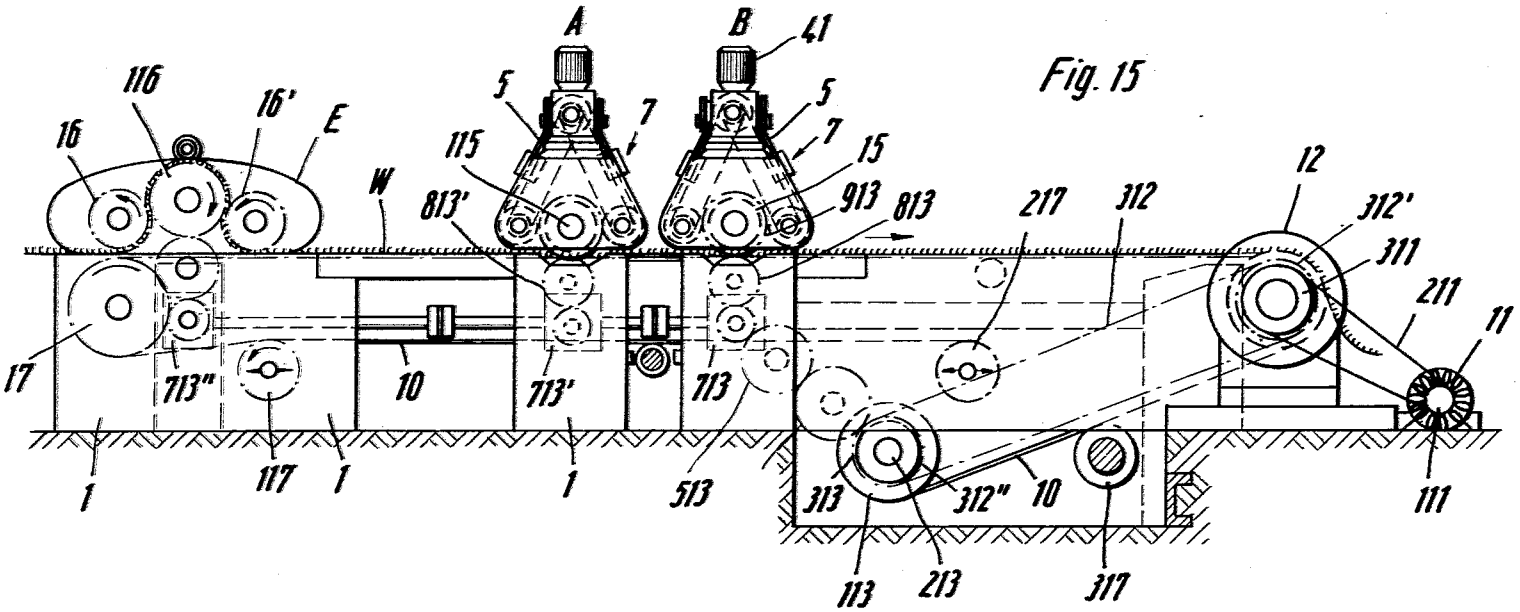
FIG. 15 is a somewhat diagrammatic side view of a screen printing machine according to a further embodiment of the invention.

FIGS. 9–14 show an embodiment which essentially corresponds to that of FIGS. 1–8 and wherein like reference numerals but with the addition of prime symbols, therefore identify like elements. The difference in FIGS. 9–11 is the omission of the connecting element 8, as already discussed with reference to FIG. 11, and the fact that the abutment means 6' are of convergent cross-section (compare FIG. 11), tapering in cross-section in direction away from the surface of the screen 5 from which they project. The grooves 71' in the slide members 177' are advantageously of the same cross-sectional configuration as the abutment means 6', and the circumferential grooves 25', 35' and 45' (not shown) formed in the rollers 2–4, respectively, may also be of the same tapering cross-section. However, as the abutment means 6' have significant freedom of displacement axially of the rollers 2–4 in the grooves 25', 35' and 45', an accommodation of the cross-section of these grooves relative to the cross-section of the abutment means 6' is not really necessary.

Evidently, the cross-sectional configuration chosen for the grooves 71' and the abutment means 6' in FIGS. 9–14 could also be employed in FIGS. 1–8, just as the embodiment in FIGS. 9–14 could be provided with the connecting element 8 of FIGS. 1–8, and with the tapering cross-sectional configuration for the abutment means 6' and the grooves 71'. In the latter case, of course, one of the screws 277 or 277' would have to be omitted.

The embodiment of FIGS. 15–20 is also reminiscent of that in FIGS. 1–8, and like reference numerals but with the addition of the suffix *a*, again identify like elements. The main difference in this embodiment of FIGS. 15–20 from the one in FIGS. 1–8 is the fact that the units 7 are not provided with slide members 177. Instead, the units 7 are each provided with a guide roller 377 which is mounted on the rod 8' or 8'', respectively, which serve as axes or shafts on which the rollers 377 are journalled for rotation, their movement axially of the rods 8', 8'' being prevented in appropriate manner, here (compare FIG. 19) because of the provision of abutment shoulders on the rods 8', 8'' which prevent the rollers 377 from moving towards one another. Evidently, the rollers 377 cannot move axially apart from one another with reference to the rods 8', 8'' since the guide means 6*a* extending into their pulley grooves 477 prevent such a movement. The rollers 377 are rotatably mounted by means of anti-friction bearings 76. Plates 74, mounted on respective bar members 77*a* of each unit 7, which bar members are secured to the members 9 by means of screws or bolts 91 as before (only one shown) and overlap the lateral edge portion of the screen 5, to prevent the abutment means 6*a* from jumping out of the pulley grooves 477. The adjacent threaded ends of the rods 8', 8'' are again connected by the tensioning sleeve 108, as described with reference to the embodiment of FIGS. 1–8. The opposite free ends of the rod members 8', 8'' extend into smooth bores 577 formed in the members 77*a* of the connected units 7, and the tensioning of the screen 5 in the two directions indicated by the double-headed arrow D is again effected by turning the sleeve 108 in requisite direction. In order to shift the screen 5 axially of the rollers 2–4, a screw 277*a* is provided which extends through one of the members 9 and is threaded into a tapped bore in one of the ends of one of the rods, in FIG. 19 into the free end of the rod 8'. By turning the screw 277*a*, which is held in the member 9 against axial displacement, in requisite direction, the rods 8', 8'' together with the two rollers 377 can be moved in one or the opposite direction indicated by the arrow F, thereby taking along the screen 5 in the same direction.

Figure 26:
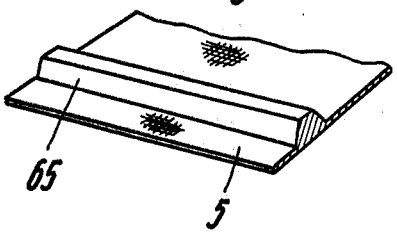
FIG. 26 is a partially sectioned fragmentary perspective illustrating still a further concept of the invention.

In this embodiment it is advantageous if the abutment means 6*a* is continuous or substantially continuous in the longitudinal direction of the screen 5, that is in the direction of the travel of the screen. Thus, the abutment means 6*a* in the embodiment of FIGS. 15–20 may utilize a member or belt 65*a* having the V-shaped cross-section shown in FIG. 26, one such member 65*a* being mounted on each of the two lateral edge portions of the screen 5. However, it is also possible to use sections of such a member 65*a* which are individually mounted on each of the edge portions of the screen 5, being spaced at relatively small distances from one another in longitudinal direction of the screen.

In all other respects the embodiment in FIGS. 15–20 is the same as in FIGS. 1–8.

Figure 21:
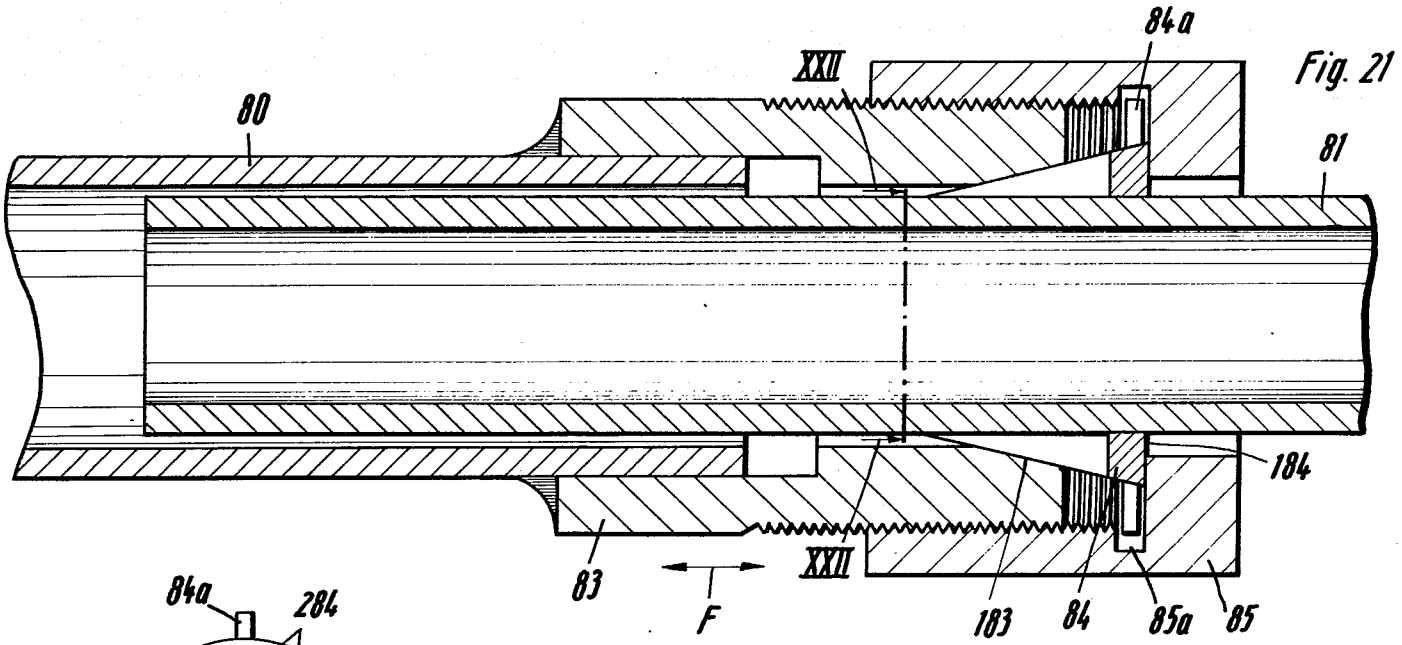
FIG. 21 is a fragmentary axial section, illustrating a detail of an embodiment of the invention.
Figure 22:
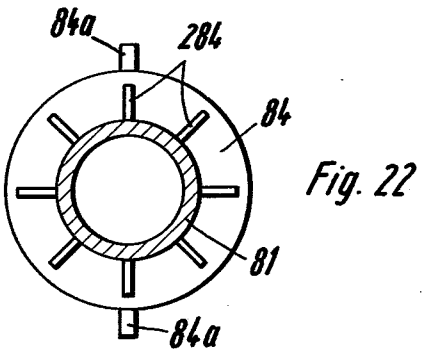
FIG. 22 is a section on line XXII—XXII of FIG. 21.

Finally, FIGS. 21 and 22 show an embodiment of a connecting element which can be used in place of the connecting element 8 shown in preceding embodiments. In FIGS. 21 and 22 a pipe or tube 80 is provided which replaces the rod member 8', and a pipe or tube 81 replaces the rod member 8''. The pipe 80 has fixedly mounted on it a tubular socket 83 which is externally threaded; the connection may be by means of a weld, as shown in FIG. 21. The free open end of this socket 83 is dimensioned to in part receive an annular conical member 84 which is provided with axially extending slots 284 and which axially shiftably surrounds the member 81. A cap nut 85 also surrounds the member 81, at an axial side of the conical member 84 which faces away from the socket 83; the cap nut 85 is internally threaded and can thus mesh with the external threads on the socket 83. Therefore, when the cap nut 85 is threaded onto the socket 83 to a requisite extent, it will press the conical member 84 into the conical recess 183 provided for this purpose in the socket 83 (i.e. towards the left in FIG. 21) so that due to the slots 284, the conical member 84 will be compressed against the pipe 81 to provide a locking action. The inner surface of the cap nut 85 may be provided with an annular recess 85*a* and the outer circumference of the conical member 84 may be provided with two or more projections 84*a* which extend into this recess 85*a* so that when the cap nut 85 is unthreaded it will move the conical member 84 with it, that is it will retract it towards the right in FIG. 21. To adjust the tension in accordance with the arrow F, the tubes 80 and 81 are pulled axially apart to the desired extent and then are locked in their selected position by tightening the cap nut 85.

The pipes 80, 81 can thus be locked in any relative position, in which they are telescoped together to a greater or lesser degree, by having the cap nut 85 bear upon the end face 184 of the conical member 84. The pipes 80, 81 may cooperate with slide members 177 or with guide rollers 377, and the adjustment of the entire arrangement together with the screen 5 may also be carried out in the manner described with respect to FIG. 6, by having a screw 277 cooperate with a closed end of one of the pipes 80, 81, such closed end for this purpose being formed with a tapped bore into which the screw 277 would extend.

Various modifications will offer themselves to those skilled in the art, from a consideration of the exemplary embodiments disclosed herein. All of these modifications are intended to be encompassed within the scope of the appended claims. It is always important, however, that no matter what modification may be made within the context of the present invention, it must be possible to tension the opposite lateral edge portions of the screen 5 in laterally outward mutually opposite directions, as indicated by the two arrowheads of the arrow D, and it is also important that each assembly composed of two of the units 7 connected by connecting elements, such as the elements 8, be in toto displaceable to some extent axially of the rollers 2–4, so that the position of the screen 5 on the rollers 2–4 can be changed in this manner. The screws 277 which have been shown as used for this purpose are, of course, only exemplary and could be replaced with other instrumentalities.

It will be understood that each of the elements described above, or two or more together, may also find a useful application in other types of instructions differing from the types described above.

While the invention has been illustrated and described as embodied in a screen printing machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a screen printing machine, a combination comprising at least two guide rollers; an endless printing screen having two lateral edge portions and being trained about said guide rollers for travel in an endless path; abutment means mounted on said edge portions for travel with said screen; and tensioning means engaging said abutment means and operative for tensioning said screen in direction transversely of said path by urging said abutment means of the respective edge portions apart from one another, said tensioning means comprising at least one pair of tensioning units each mounted adjacent one of said edge portions, a tube having opposite ends connected to the respective units and being composed of two telescoped-together tube sections, and means for arresting said tube sections in respective telescoped positions, one of said tube sections surrounding the other tube section and said other tube section being surrounded by a slidable conical wedge member formed with axial slots, said one tube section having an end portion on which an externally threaded enlarged-diameter tubular socket is fixedly mounted, and a cap-nut turnably surrounding said other tube section and meshing with the threads of said socket for urging said wedge member into said socket.

2. In a screen printing machine, a combination comprising at least two guide rollers each having a shaft; further comprising bearing means journalling said shafts at opposite ends of said rollers for rotation; and support members mounted on and each embracing one of said shafts in the region of the respective bearing means; an endless printing screen having two lateral edge portions and being trained about said guide rollers for travel in an endless path; abutment means mounted on said edge portions for travel with said screen; tensioning means engaging said abutment means and operative for tensioning said screen in transverse direction by urging said abutment means of the respective edge portions apart from one another, said tensioning means comprising guide means mounted on said support members and having guide tracks which extend lengthwise of said path and wherein said abutment means are engaged, said guide means each comprising at least one guide unit each having an angle member which partly surrounds a space in which the respective guide track is formed and which space has an open side, a cover member mounted on said angle member overlying said open side and a respective edge portion of said screen, and a block member located in said space and in part bounding said guide track, said block member being mounted on its associated angle member adjustable relative to the same; and means for shifting said block members of the guide units at said edge portions in unison relative to their associated angle member.

3. A combination as defined in claim 2; and further comprising means mounting said rollers for rotation about substantially parallel axes.

4. A combination as defined in claim 2, wherein said two rollers have axes of rotation located in a substantially horizontal first plane; and further comprising another roller about which said screen is also trained and which has an axis of rotation located in a substantially horizontal second plane vertically spaced from said first plane.

5. A combination as defined in claim 2, wherein said two rollers are mounted for rotation about parallel axes located in a horizontal plane; further comprising an additional roller about which said screen is also trained and which is mounted for rotation about an axis located in a plane above said two rollers, so that said rollers are located at the corners of an imaginary triangle; and wherein said tensioning means comprises elements located intermediate said planes.

6. A combination as defined in claim 2, wherein said abutment means comprises a pair of V-belts each mounted on one of said edge portions; said guide units each being formed with a V-groove in which the respective V-belt is received.

7. A combination as defined in claim 2, wherein said abutment means comprises a plurality of elongated bar sections mounted on the respective edge portions and spaced therealong, each bar section having a leading end portion which faces in the direction of travel of said screen and which tapers in said direction.

8. A combination as defined in claim 2, wherein said abutment means comprises a plurality of elongated bar sections mounted on the respective edge portions and spaced therealong, each bar section having a leading end portion which faces in the direction of travel of said screen.

9. A combination as defined in claim 8, said comprising guide units edge portions and each being provided with a guide groove for travel of said bar sections therethrough, said bar sections having at least at said leading end portions thereof respective guide faces for facilitating entry into said grooves.

10. A combination as defined in claim 8; further comprising mounting means mounting said bar sections on said edge portions of said screen.

11. A combination as defined in claim 2, said abutment means comprising abutment provided members abutment on the respective edge portions and each being elongated lengthwise thereof; and wherein opposite axial ends of said rollers are each provided adjacent the respective edge portions with circumferential guide grooves dimensioned to permit free travel of said abutment members therethrough.

12. In a screen printing machine, a combination comprising at least two guide rollers each having a shaft; bearing means journalling said shafts at opposite ends of said rollers for rotation; support members mounted on and each embracing one of said shafts in the region of the respective bearing means; an endless printing screen having two lateral edge portions and being trained about said guide rollers for travel in an endless path; abutment means mounted on said edge portions for travel with said screen; tensioning means engaging said abutment means and operative for tensioning said screen in transverse direction by urging said abutment means of the respective edge portions apart from one another; said tensioning means comprising guide means mounted on said support members and having guide tracks which extend lengthwise of said path and wherein said abutment means are engaged, said guide means each comprising at least one guide unit having an angle member which partly surrounds a space in which the respective guide track is formed and which space has an open side, a cover member mounted on said angle member overlying said open side and a respective edge portion of said screen, and a block member located in said space and formed with a portion of said guide track, said tensioning means further comprising connecting means connecting said block members of the guide units at said edge portions and operative for varying the spacing between the connected block members; and a screw for shifting the connected block members in unison transversely of said path.

13. In a screen printing machine, a combination comprising at least two guide rollers; an endless printing screen having two lateral edge portions and being trained about said guide rollers for travel in an endless path; abutment means mounted on said edge portions for travel with said screen; tensioning means engaging said abutment means and operative for tensioning said screen in transverse direction by urging said abutment means of the respective edge portions apart from one another, said tensioning means comprising at least two guide units each located adjacent one of said edge portions, and connecting means connecting said guide units with one another and including two aligned rods having respective first end portions each fixedly secured to one of said guide units and respective second end portions which are located proximal one another and formed with a right-hand and a left-hand thread, respectively, and a nut threaded onto said second end portions for axially urging said rods apart in response to turning of said nut in requisite direction; and shifting means for shifting said tensioning means and thereby said screen transverse to the direction of travel of said screen.

14. A combination as defined in claim 13; and further comprising securing pins securing said first end portions non-rotatably to the respective guide units.

15. In a screen printing machine, a combination comprising at least two guide rollers having shafts the respective end portions of which project axially beyond the respective rollers; an endless printing screen having two lateral edge portions and being trained about said guide rollers for travel in an endless path; support members mounted at said shaft end portions; abutment means mounted on said edge portions for travel with said screen; tensioning means engaging said abutment means and operative for tensioning said screen in transverse direction by urging said abutment means of the respective edge portions apart from one another, said tensioning means comprising at least two tensioning units each located adjacent one of said edge portions and having a bar member mounted on a respective support member, a split shaft connecting said bar members, means for changing the length of said split shaft, and a pulley mounted on said split shaft adjacent each of said bar members and having a pulley groove in which said abutment means engages; and shifting means for shifting said tensioning means and thereby said screen transverse to the direction of travel of said screen.

16. A combination as defined in claim 15; and further comprising shifting means for shifting said split shaft and pulleys in axial direction of said split shaft.

17. A combination as defined in claim 15, wherein said split shaft includes two aligned rods having respective first end portions slidably received in recesses of said bar members and respective second end portions which are located proximal to each other and formed with a right-hand and a left-hand thread, respectively, and a nut threaded onto said second end portions for axially urging said rods apart in response to turning of said nut in requisite direction.

18. A combination as defined in claim 15; further comprising a retaining member mounted on each of said bar members and overlapping the pulley groove of the adjacent pully out of contact therewith, for preventing said abutment means from becoming disengaged from the pulley groove.

* * * * *